US005330311A

United States Patent [19]

Cawley et al.

[11] Patent Number: 5,330,311

[45] Date of Patent: Jul. 19, 1994

[54] ROBOT MEANS FOR UNLOADING OPEN BOXES

[75] Inventors: Clifton M. Cawley, Nederland; Wesley D. Cawley, Port Neches, both of Tex.

[73] Assignee: Ohmstede-Cawley, Ltd., Beaumont, Tex.

[21] Appl. No.: 63,224

[22] Filed: May 14, 1993

[51] Int. Cl.[5] ..... B65G 65/00

[52] U.S. Cl. ..... 414/416; 294/2; 294/64.1; 414/661; 414/797; 901/39

[58] Field of Search ..... 414/403, 416, 419–421, 414/661, 627, 752, 753, 737, 739, 796.5, 797; 901/6, 7, 39, 40; 294/2,106, 64.1

[56] References Cited

U.S. PATENT DOCUMENTS

| | | | |
|---|---|---|---|
| 3,051,328 | 8/1962 | Brown et al. | 901/18 X |
| 4,242,025 | 12/1980 | Thibault | 901/40 X |
| 4,355,936 | 10/1982 | Thomas et al. | 294/2 X |
| 4,392,766 | 7/1983 | Blunt | 901/40 X |
| 4,527,940 | 7/1985 | Biery | 414/416 |
| 4,553,892 | 11/1985 | Huffman et al. | 901/40 X |
| 4,569,182 | 2/1986 | Leuvering | 53/456 |
| 4,627,785 | 12/1986 | Monforte | 414/730 |
| 4,657,470 | 4/1987 | Clarke et al. | 414/627 |
| 4,828,304 | 5/1989 | No et al. | 294/2 |
| 4,954,042 | 9/1990 | Becicka et al. | 414/718 |
| 4,976,584 | 12/1990 | Focke | 414/789.6 |
| 5,000,649 | 3/1991 | Hawkes | 414/680 |
| 5,024,575 | 6/1991 | Anderson | 414/627 |
| 5,052,168 | 10/1991 | DeWitt et al. | 53/492 |
| 5,085,556 | 2/1992 | Ohtomi | 414/744.3 |
| 5,087,169 | 2/1992 | Tubke | 414/792.9 |
| 5,098,254 | 3/1992 | Becicka et al. | 414/792.9 |
| 5,102,114 | 4/1992 | Suda | 271/18 |
| 5,108,255 | 4/1992 | Cornacchia | 414/792.8 |
| 5,112,181 | 5/1992 | Rasmussen | 294/2 X |
| 5,222,861 | 6/1993 | Focke et al. | 414/416 X |
| 5,271,710 | 12/1993 | Decharran et al. | 414/421 X |

*Primary Examiner*—David A. Bucci
*Attorney, Agent, or Firm*—Fulbright & Jaworski

[57] ABSTRACT

A robot for depalletizing open top boxes having a product from a pallet, removing the box from the product, unloading the product onto a magazine conveying surface and picking up slip sheets.

13 Claims, 6 Drawing Sheets

ROBOT MEANS FOR UNLOADING OPEN BOXES

BACKGROUND OF THE INVENTION

The present invention is directed to a robot which removes open top boxes, having a product therein, in sequence from a pallet, inverts the box while holding the box and product, places the box on a box stripper for separating the product from the box, removes the empty box, picks up the product and loads the product on a magazine conveyor at the proper location.

Many products are shipped in open top boxes in layers on pallets. However, when the pallets reach their destination, the product must be removed from the boxes and positioned for use. For example only, the boxes may contain a plurality of folded or unassembled cardboard boxes which are to be used in other operations to contain different products.

In order to speed up the unloading process and economize this operation, the present invention is directed to a robot which locates and removes stacked boxes, containing a product to be unloaded, from a pallet, provides a box stripping machine for assisting in removing the open top box from its product after placement by the robot, unloads the product onto a magazine conveyor that may have a variable amount of product, and picks up and places slip sheets which are positioned between different levels of boxes on a pallet.

SUMMARY

The present invention is directed to a robot for picking up open top boxes containing product, assisting in removing the product from the box, and setting the product on a conveyor. The robot includes a body having first and second spaced ends in which one of the ends is open. The body includes four sides, the first of the sides being fixed and the opposite second side being open. The third and fourth sides include one edge pivotally connected to the fixed side and include a ledge on the opposite edge extending towards the inside of the body for holding the box and product therein when the box is inverted. A sensor is connected to the body for detecting the presence of a box relative to the body, and means are connected to the body for rotating the body about its longitudinal axis and for moving the body in an X, Y and Z direction. A carriage is positioned in the body for longitudinal movement therein, and suction means are provided on the carriage for engaging and gripping one end of the box and pulling the box into the body when the carriage is retracted. Rotatable and extendable suction means are connected to each of the third and fourth sides for gripping the sides of the box in the body.

A still further object of the present invention is wherein the robot includes means for lifting the suction means on the carriage upwardly.

Yet a further object is the provision of extendable and retractable holding means on the body adjacent the open end of the body for holding product in the body. Preferably, the holding means includes a rod connected to each of the third and fourth sides and is extendable over the open end.

Yet a further object of the present invention is wherein the length of one of the ledges is longer than the length of the other ledge for assisting in positioning the product on a conveyor.

Still a further object is the provision of rotatable arm means on each of the third and fourth sides having vacuum means for handling slip sheets.

Still a further object of the invention is the provision of a box stripper for receiving a box from the robot and separating the product from the box. The box stripper includes a support for receiving an inverted box, containing product, in which the support has first and second ends. Vertical stop means are provided at the first end and at the second end for positioning the box on the support. Suction means at each of the first and second ends of the support are provided for engaging and pulling opposite ends of the box away from the product in the box, and movable clamping fingers are adjacent each end of the support for moving the fingers into the box between the product and each end of the box. Additionally, means are provided for moving the clamping means towards and away from each other for clamping the product therebetween. Preferably, the vertical stop means at each end includes spaced first and second stops and the suction means at each end of the first and second ends of the support are movable into position between the spaced stops at the respective ends. Preferably, the vertical stop means at the second end is rotatable into and out of position.

Other and further objects, features and advantages will be apparent from the following description of a presently preferred embodiment of the invention, given for the purpose of disclosure, and taken in conjunction with the accompanying drawings.

DESCRIPTION OF THE PREFERRED EMBODIMENT

While the present invention will be described as unloading and emptying folded cardboard cartons from an open top box, for purposes of illustration only, the present invention is useful for depalletizing, removing, and loading other types of product from an open top box and placing the product on a magazine conveyor.

Figure 1:
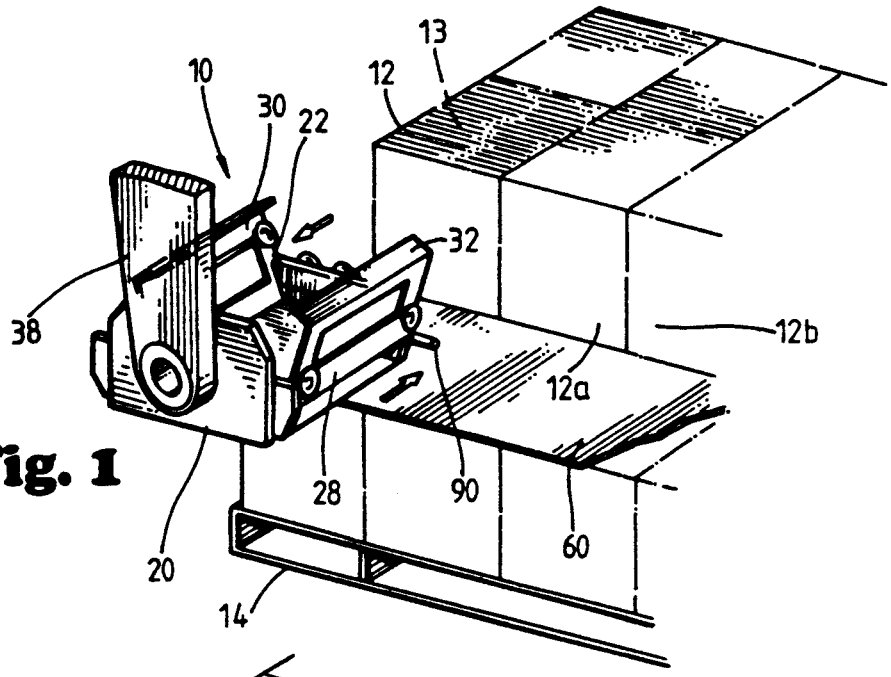
FIG. 1 is a fragmentary, elevational perspective view illustrating the robot of the present invention moving to pick up one of a plurality of boxes on a pallet.
Figure 2:
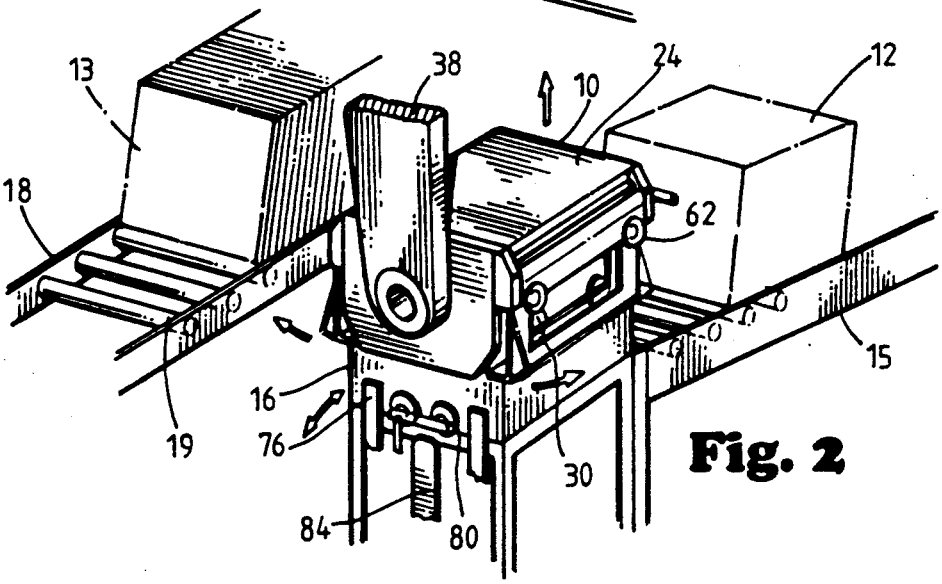
FIG. 2 is a fragmentary, elevational perspective view illustrating the placement and removal of a box from the product and the placement of the product on a magazine conveyor.

Referring now to the drawings and particularly to FIGS. 1 and 2, the reference numeral 10 generally indicates the robot of the present invention for individually and sequentially removing a plurality of boxes 12, 12*a*, 12*b*, etc. from a pallet 14, inverting and placing the box on a box stripper 16 (FIG. 2) and removing the box 12 from the product 13 and thereafter picking up the removed product 13 and placing the product 13 on a magazine conveyor 18.

Referring now to FIGS. 1–6, the robot 10 includes a body having a first end 20 and a second end 22, one of which is open such as the second end 22. The body also includes four sides, the first side 24 being fixed and the opposite second side being open and third and fourth sides 28 and 30 each having one edge pivotally connected to the fixed side 24. The opposite edges of each of the third and fourth sides 28 and 30 include a ledge 32 and 34, respectively, extending inwardly toward the inside of the body for holding both the product 13 therein and the box 12 when the box 12 is inverted.

Figure 4:
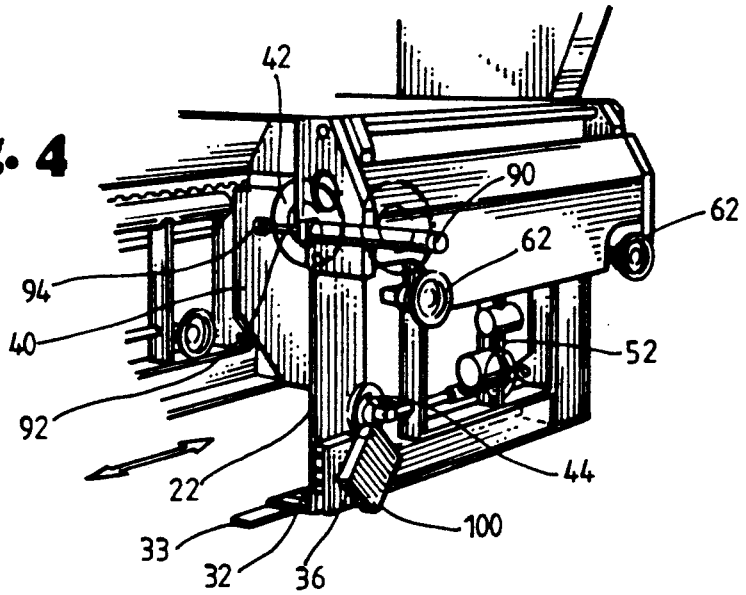
FIG. 4 is a fragmentary, elevational perspective view of the robot of FIG. 3 from an opposite view.

Referring to FIG. 4, a first sensor 36 is connected to the body for detecting the presence of a box 12 relative to the body. The sensor 36 may be a conventional convergent beam photoeye that detects when the front face of the box 12 is a predetermined distance from the sensor, such as 1¾ inches. Additionally, control means (FIGS. 1, 2, 3 and 10) 38 are connected to the body for rotating the body about its longitudinal axis and for moving the body in X, Y and Z directions.

Referring now to FIGS. 4, 5, 6, 6A and 10, a carriage 40 is longitudinally movable in the inside of the body and suction means, such as suction cups 42, are provided on the carriage 40 for engaging and gripping one end of a box 12, and pulling the box 12 into the inside of the body when the carriage 40 is retracted.

Figure 7:
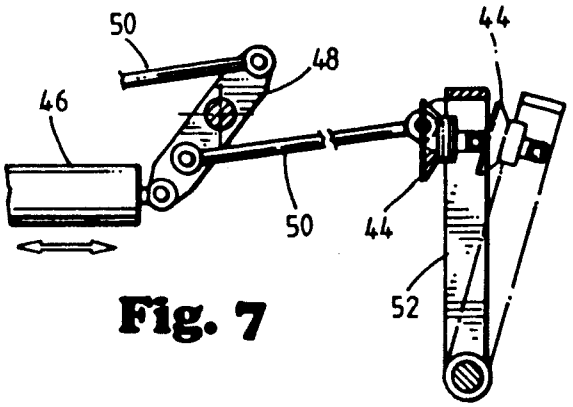
FIG. 7 is a fragmentary, elevational view of the mechanism for moving suction means on the movable sides inwardly and outwardly.

Referring now to FIGS. 4, 5, 6, 7 and 10, side suction means, such as suction cups 44, are provided and pivotally connected to each of the third and fourth sides 28 and 30 for gripping and holding the sides of a box 12. As shown in FIG. 7, an actuator 46, such as a piston and cylinder, is connected to a rotatable plate 48 which in turn is connected to rods 50 for actuating suction holders 52 for moving the suction cups 44 on both sides 28 and 30 into and out of engagement of a box 12 positioned in the cavity of the body.

Figure 8:
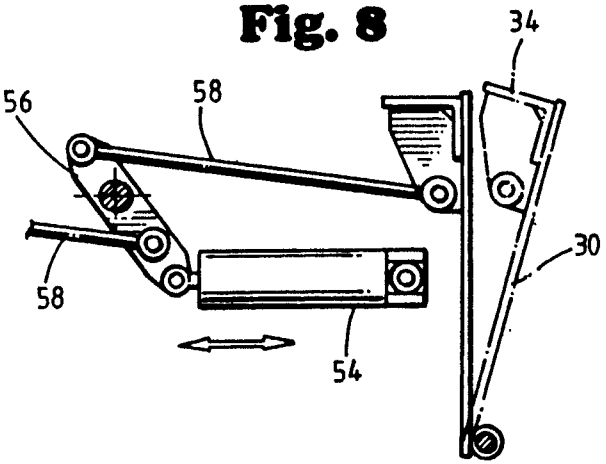
FIG. 8 is a fragmentary, elevational view of the mechanism for moving the movable sides of the robot of FIG. 3 inwardly and outwardly.

Referring now to FIG. 8, an actuator 54, such as a piston and cylinder, is connected to a linkage 56 which moves rods 58 for moving the third and fourth sides 28 and 30 inwardly and outwardly (only side 30 is shown for convenience).

Figure 10:
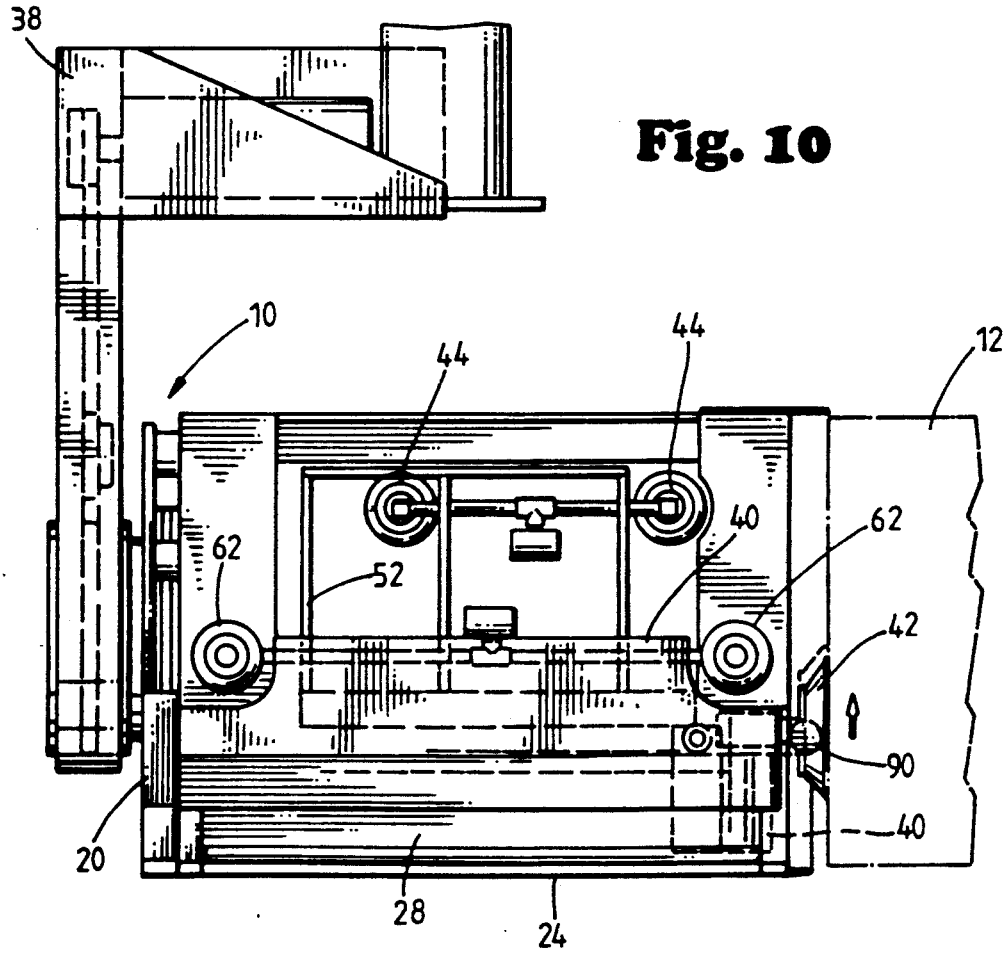
FIG. 10 is the fragmentary, elevational view of the robot of FIG. 3 gripping a box.
Figure 12:
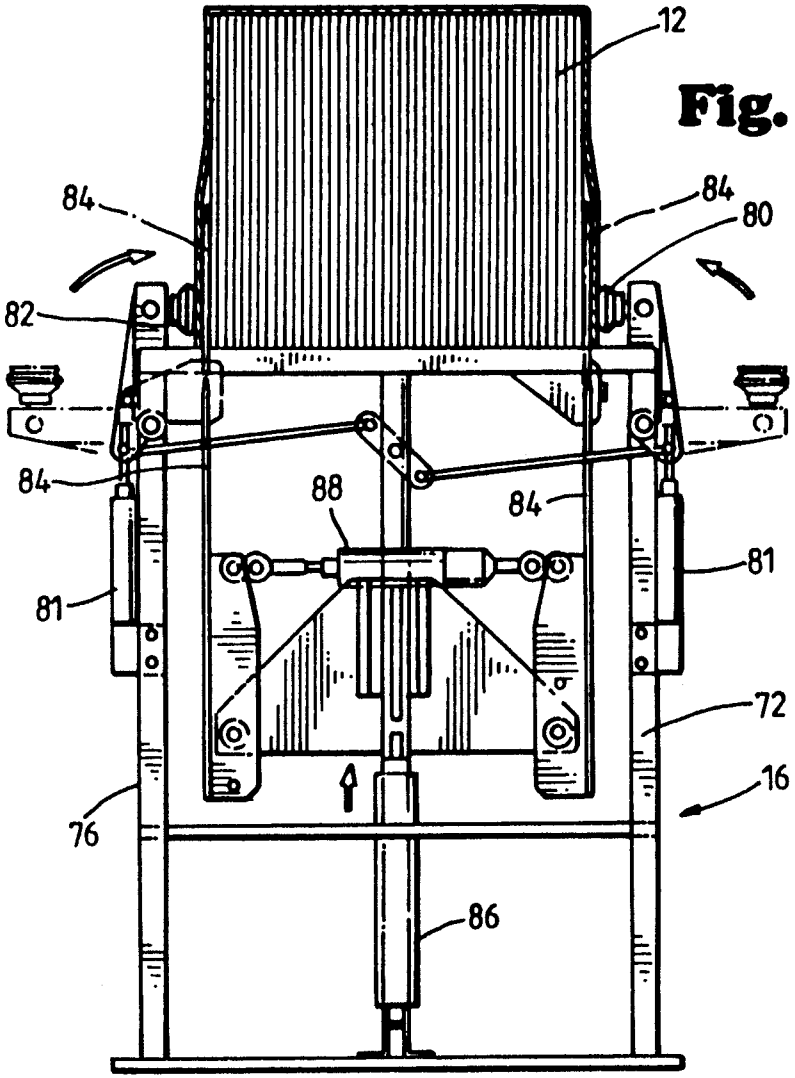
FIG. 12 is a side elevational view of the box stripper of FIG. 11.
Figure 11:
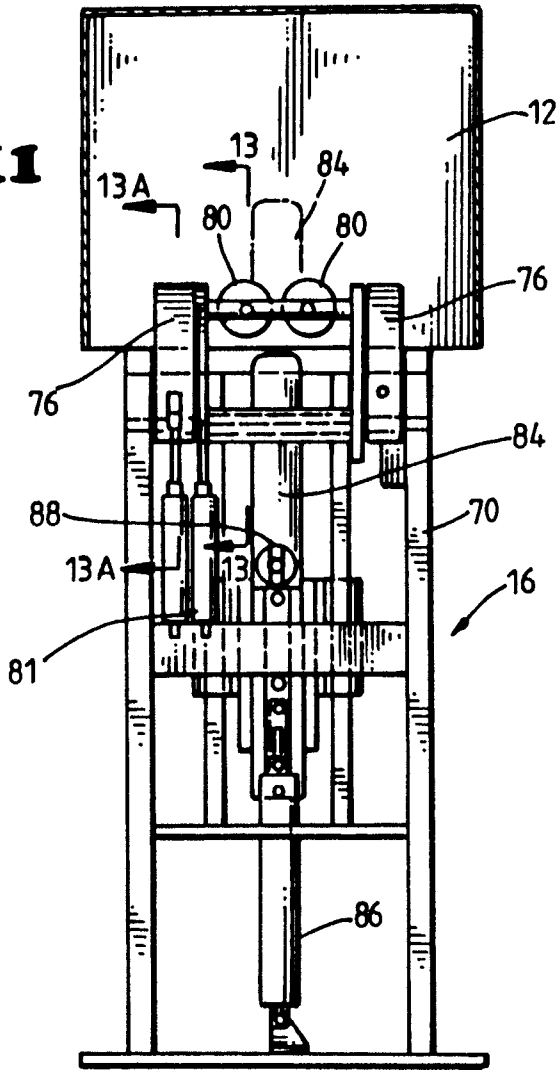
FIG. 11 is an elevational view of the box stripper that removes product from a box.
Figure 14:
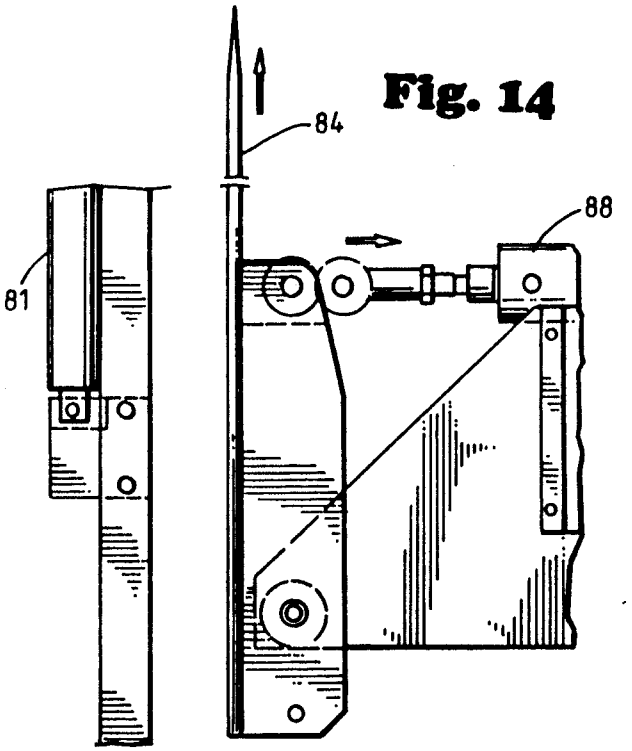
FIG. 14 is an enlarged, fragmentary elevational view of the clamping fingers of the box stripper of FIG. 11.

Referring now to FIGS. 1 and 10, the control means 38 moves the robot in a linear horizontal path, defined to be the Y axis plane, towards the face of a box 12. When the sensor 36 is a predetermined distance from the end of the box 12, the sensor 36 switches and the robot 10 records this Y position. The control means 38 moves the robot 10 in a linear vertical path, defined to be the Z axis plane, until the sensor 36 again switches and this position is recorded. The robot 10 is then moved in a Z direction downwardly until the sensor 36 switches. The robot 10 then moves parallel to the end of the box 12, defined as the X axis plane, until the sensor again switches. Thus, the robot 10 finds where the box is and the X, Y, Z space and is moved to a waiting position at the end of the box which is then aligned with the cavity in the body. The vacuum cups 42 are actuated and placed in contact by the carriage 40 with the end of the box 12. With vacuum turned on, the cups 42 will engage and hold the end of the box 12. As best seen in FIG. 6A, an actuator 45 moves the vacuum cups 42 upwardly, such as one inch, guided by guide rods 47 for lifting the bottom edge of the box 12 up so that its bottom surface is above the inside of the fixed side 24. Preferably, the front edge 25 of the fixed side 24 is beveled to prevent a snag occurring with the box 12 as it is pulled into the cavity of the body. The carriage 40 is pulled into the inside of the body pulling the box 12 into the body where it is supported from the inside of the fixed side 24. The vacuum to the cups 42 are now deactuated.

During the loading of a box into the cavity of the robot 10, the pivoting third and fourth sides 28 and 30 have been extended outwardly into the dotted position by the actuator 54 (FIG. 8) and as best seen in FIG. 1. Similarly, the suction cups 44 are extended outwardly to the dotted position by actuator 46 (FIG. 7). After the box 12 is inside the cavity of the body, the actuator 54 moves the third and fourth sides 28 and 30 inwardly to bring the ledges 32 and 34 over the top of opposing sides of the box 12 for holding both the box 12 and the product 13 therein. In addition, the actuator 46 (FIG. 7) brings the suction holders 52 inwardly to bring the suction cups 44 on each side of the box 12 into engagement with the sides of the box and vacuum is applied to the cups 44. At this point, the box 12 and its product is held in the robot 10 and the control means 38 may now invert the robot 10 and move the box and the product to another position such as shown in FIG. 2 to a box stripper 16. Of course, the robot 10 may be used in other applications for merely picking up and moving a box 12 and its contents to various locations, inverting the box and its contents.

Figure 5:
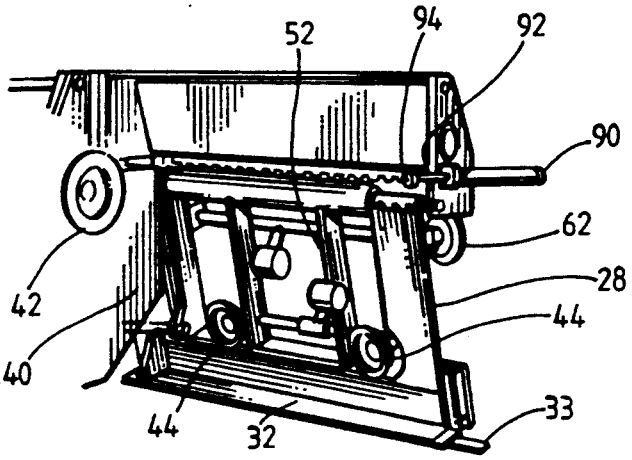
FIG. 5 is a fragmentary, elevational perspective view of the inside of one of the movable sides of the robot of FIG. 3.
Figure 6:
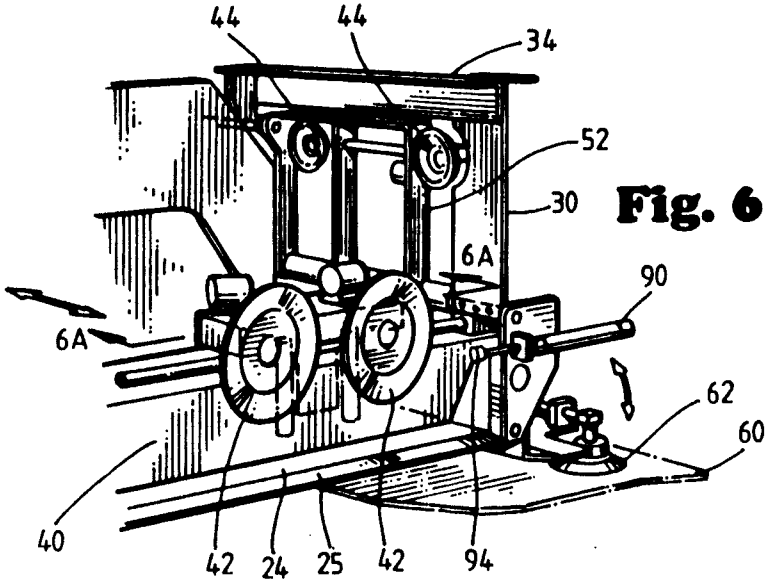
FIG. 6 is a fragmentary, elevational perspective view of the front of the robot of FIG. 3 shown picking up a slip sheet.
Figure 6A:
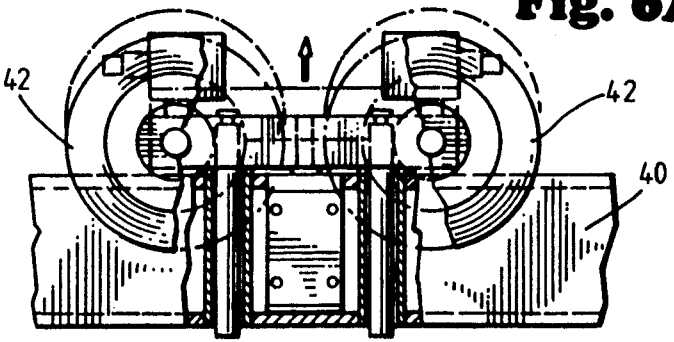
FIG. 6A is a fragmentary view taken along the line 6A—6A of FIG. 6.
Figure 9:
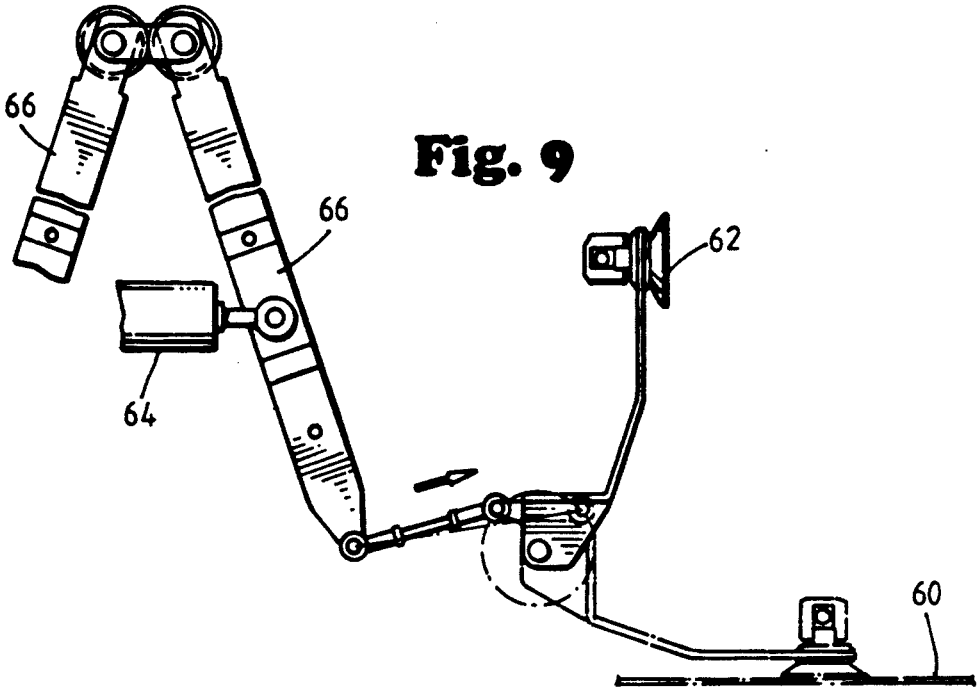
FIG. 9 is a fragmentary, perspective elevational view of the mechanism for retracting and extending the suction means of FIG. 3 that pick up slip sheets.

Referring to FIGS. 1 and 6, slip sheets 60 are conventionally provided for separating various layers of palletized boxes. As best seen in FIGS. 1–6, and 9, suction means, such as cups 62, are provided pivotally connected to the third and fourth sides 28 and 30 for outward and downwardly rotatable movement for gripping and removing slip sheets 60. Thus, as best seen in FIG. 9, actuator 64 controls arms 66 for moving the suction cups 62 from a retracted position to a slip engaging position. Thus, the robot may be moved to a center X, Y position on the slip sheets 60, vacuum applied to the cups 62 and the robot 10 removes the slip sheet 60 to a desired position to uncover the next lower level of boxes 12.

Figure 13:
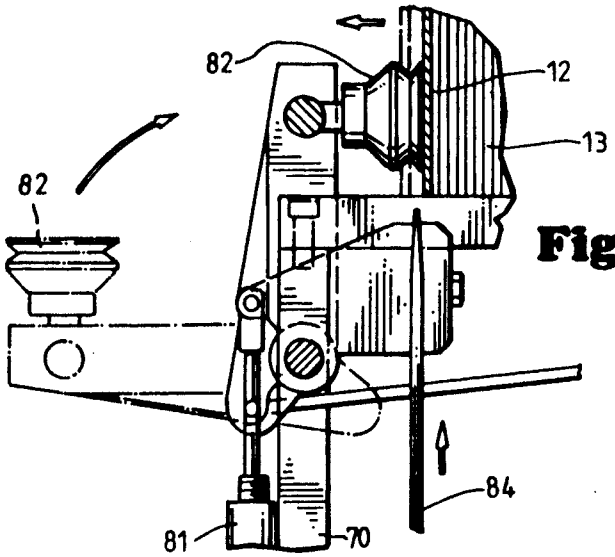
FIG. 13 is an enlarged, fragmentary elevational view illustrating the extension and retraction of suction means on the box stripper of FIG. 11.
Figure 13A:
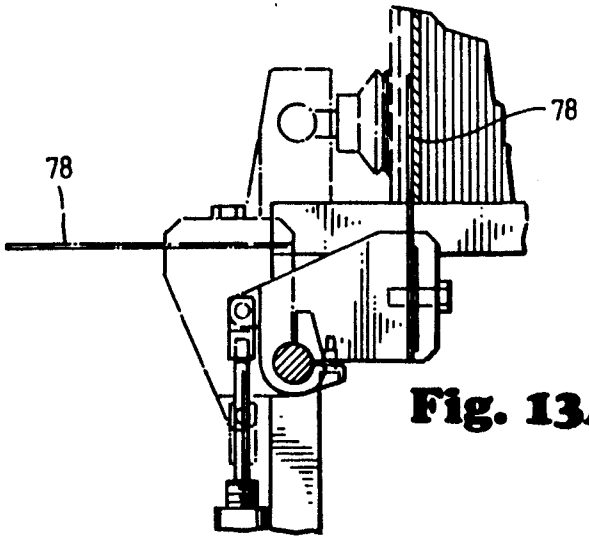
FIG. 13A is an enlarged, fragmentary view of the movable stop used in FIG. 13.

As previously indicated, the inverted box and product are carried by the robot 10 to a box stripper 16. The box stripper 16 assists in removing the box 12 from the product 13. Referring now to FIG. 2 and FIGS. 11–16, the box stripper 16 is shown which generally includes a support 70 for receiving an inverted box containing product. The support 70 includes a first end 72 and a second end 74. Vertical stop means 76 and 78 are provided at the first end and at the second end, respectively, for positioning the box on the support 70. The purpose of the box stripper is to engage and securely hold the product 13 that is in the box 12 so that the box 12 may be removed. The box 12 must have an open top, and the ends must be made from a flexible material. However, the products or contents of the box may be various types of goods that are not permanently attached to the inside of the box. The box 12 is placed on the support 70 by the robot 10 in an inverted position, centered on the support 70. Preferably, the vertical stop means 76 and 78 each include two vertical rests that rise above and are perpendicular to the top of the support 70. The vertical stop means 76 is preferably fixed. The vertical stop means 78 at the second end is normally retracted (FIG. 13A), but when actuated, is positioned to engage the opposite end of the box 12 to the stationary support 70. Thus, the box 12 is placed on the top of the support 70 and against the two stationary vertical stops 76 thereby aligning the box on the top of the box stripper 70. The movable vertical stop means 78 is moved into position by actuator 77 after the box 12 is set on the support 70. After positioning the box 12 on the box stripper 16, the vacuum to cups 44 is turned off, cups 44 are retracted, and arms 28 and 30 are extended, and at this point robot 10 is no longer holding box 12.

Figure 15:
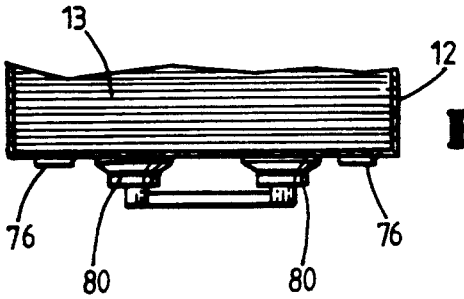
FIG. 15 is a fragmentary elevational view of the vertical stops and suction cups of the box stripper engaging a box.
Figure 16:
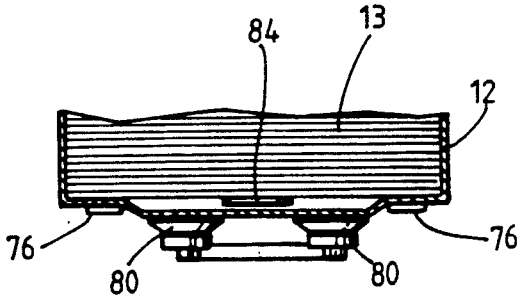
FIG. 16 is similar to FIG. 15 showing the actuation of the suction cups and the action of clamping fingers in position between the box and product therein.
Figure 3:
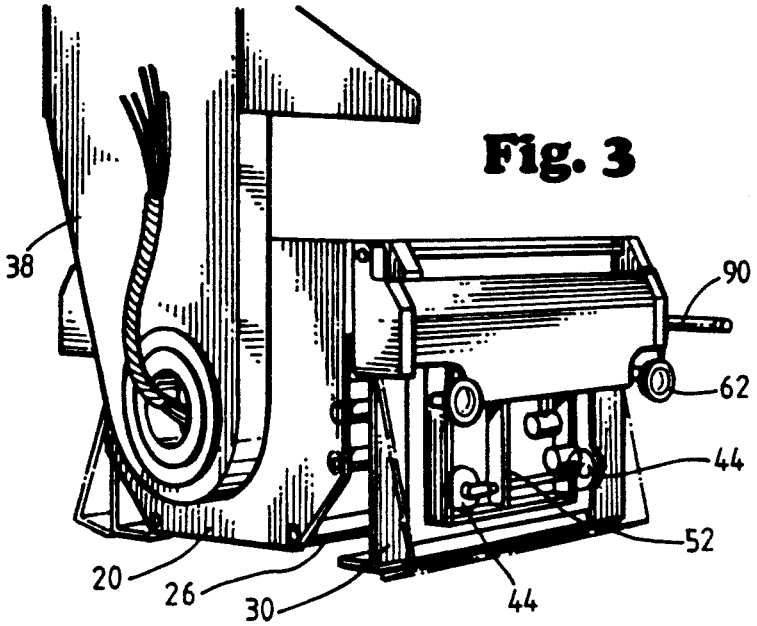
FIG. 3 is a fragmentary, elevational perspective view of the outside of the present robot invention.

Both the vertical stop means 76 and 78 perform an important function, particularly when the product in the box is flexible and/or in the same plane as the end of the box. The vertical stop means 76 (and also stop means 78) as best seen in FIGS. 15 and 16, are spaced apart from each other and positioned adjacent the corners of the end of the box 12. Suction means 80 and 82 are positioned at each of the first 72 and second 74 ends of the support 70, respectively, for engaging and pulling opposite ends of the box away from the product 13 in the box 12. It is to be noted that the suction cups 80 and 82 are rotatable into and out of engagement with the ends of the box 12 and when in engagement with the ends of the box 12 are positioned between the dual spaced stops at each end of the box 12. When vacuum is applied to the vacuum cups 80 and 82, the ends of the box are pulled back and must bend around the vertical stops 76 and 78. If the stops 76 and 78 were not there, the ends of the box 12 would pull out from edge to edge and in the case of a flexible product 13, the product 13 then follow the ends of the box 12 as it is being pulled out. The product 13 tends to be held in place because of the stops 76 and 78 when the ends are pulled out. Thus, when the ends of the box 12 are pulled out by the suction cups 80 and 82, an opening is exposed between the inside of the ends of the box 12 and the product 13 therein.

Movable clamping fingers 84 are provided adjacent each end 72 and 74 of the support 70 for moving the fingers 84 into the box 12 into the opening between the product 13 and each end of the box 12 created by the suction cups 80 and 82.

Actuator 86 moves the clamping fingers 84 upwardly into the openings between the product 13 and the ends of the box 12 and actuator 88 moves the fingers 84 towards each other thereby clamping the product 13 between the fingers 84 so that the box 12 can be removed without disturbing the contents. Preferably, the upper ends of the holding fingers are pointed for ease of entry into the box without scraping or tearing the box or the product 13 therein. After the product 13 is clamped together, the vacuum to the cups 80 and 82 are discontinued and the vacuum cups 80 and 82 are rotated back to their initial retracted position by actuators 81. The movable vertical stop support 78 is indexed down to its initial starting position.

With the product 13 clamped by the fingers 84 and the grip on the box 12 by the box stripper 16 removed, the box 12 can be removed by the robot 10. The robot 10 now moves down in the Z direction over the box 12 on the box stripper 16. The mechanism in FIGS. 7 and 5 is actuated to bring the vacuum cups 44 against the side of the box 12 and vacuum is applied. The robot 10 now has the box 12 in its grasp. The robot 10 moves the empty box 12 upwardly leaving the product 13 secured in the grip of the clamping fingers 84. The box 12 is then dumped by turning off the vacuum to the cups 44 and the suction cup holders 52 are now placed in the retracted or dotted position as best seen in FIG. 7. The robot now is ready to pick up the product 13 which is still held in position between the clamping arms 84 on the box stripper 16. The robot 10 is then moved in the same X, Y, Z position where it originally set down the box 12 on the box stripper 16 and is now prepared to pick up the product 13 from the box stripper 16. The actuator 54 (FIG. 8) which at this time is in an inverted position to that shown in FIG. 8, brings the ledges 34 and 36 of the sides 30 and 28, respectively, inwardly to engage the under side of the product 13. With the ledges 32 and 34 supporting the product 13, the robot 10 may now support the unboxed product 13.

Referring now to FIGS. 1–6, a rod 90 is connected to each of the sides 28 and 30 and extends into the front open end 22 of the robot 20 for preventing products 13 from falling out the front opening 22 when the robot 10 moves away from the box stripper 16. The rods 90 include a piston and cylinder actuator 92 and preferably include a ball bearing 94 at the inner extent of the rod 90 to keep the closest product 13 from sticking on the rod 90.

The clamping fingers 88 of the box stripper 16 releases its grip on the product 13 as the robot 10 has sufficiently enclosed and gripped the product within its cavity at the time of the clamping fingers 84 retraction. As best seen in FIG. 2, the robot 10 moves away from the box stripper 16 where it is ready to release its enclosed product 13 on the magazine conveyor 18. The robot 10 must load its present load of product 13 at a predetermined point on the conveyor 18 or probe for and load on the conveyor 18 where preplaced product 13 is already positioned and may be moving on the conveyor 18.

Referring to FIG. 4, the robot 10 includes a second sensor 100. After the robot moves to the proper X and Z coordinate and runs the Y position in the Y axis towards any product 13 on the conveyor 18, the sensor 100 will switch, if its beam encounters the bottom edge of the last product 13 placed on the conveyor 18. With the known position of the preplaced product 13, the robot 10 will move to the correct Y coordinate for releasing the product 13 in the robot 10. After placement, the sides 28 and 30 are opened removing the ledges 32 and 34 from underneath the product and the product 13 falls to the conveyor 18 as the rods 90 are retracted. A leaf spring (not shown) may be mounted upon the inside of the first end 20 of the robot 10 for preventing the last product 13 sticking. The robot is raised vertically and ledges 32 and 34 are then brought back in to clamp the edges of the product 13 by the sides of the ledges 32 and 34. The robot 10 moves the product 13 that is clamped against a guide rail 19 on the conveyor 18 in the X direction to correctly position the product 13 on the conveyor 18. It is to be noted in FIGS. 4 and 5, that ledge 32 includes an extension 33 making it longer than the ledge 34 on the side 30. Therefore, the ledge 32 with its extension 33 that is moving the product 13 against the guide 19 is used as some loose cartons will not always fall straight down but, occasionally somewhat forward. With the added length 33 the ledge will insure that all cartons are pushed against the guide 19.

At this point, the rods 90 are retracted and the ledges 32 and 34 are retracted and at this point the product 13 is resting on the conveyor 18 against the previously placed product 13. To avoid the possibility that some loose cartons may spring back, the carriage 40 and cups 42 may be moved forwardly out a distance sufficient to push any cartons forward that are leaning back. The robot 10 then moves in a linear Z path up and is ready to repeat the process.

The present invention, therefore is well adapted to carry out the objects and attain the ends and advantages mentioned as well as others inherent therein. While a presently preferred embodiment of the invention has been given for the purpose of disclosure, numerous changes in the details of construction will be readily apparent to those skilled in the art, and which are encompassed within the spirit of the invention and the scope of the appended claims.

What is claimed is:

1. A robot for picking up open top boxes containing product, assisting in removing the product from the box, and setting the product on a conveyor comprising, a body having first and second ends, one of said ends being open, and having four sides, the first of the sides being fixed and the opposite second side being open, and the third and fourth sides each having one edge pivotally connected to the fixed side and having a ledge on an opposite edge extending towards an inside of the body for holding the box and product therein when the box is inverted, a sensor connected to the body for detecting the presence of a box relative to the body, means connected to the body for rotating the body about its longitudinal axis and for moving the body in an X, Y and Z direction, a carriage positioned in the body for longitudinal movement therein, suction means on the carriage for engaging and gripping an end of the box and pulling the box into the body when the carriage is retracted, and retractable and extendable suction means connected to each of the third and fourth sides for gripping the sides of a box in the body.

2. The robot of claim 1 including means for lifting the suction means on the carriage.

3. The robot of claim 1 including, an extendable and retractable holding means on the body adjacent the open end for holding product in the body.

4. The robot of claim 3 wherein said holding means includes a rod connected to each of the third and fourth sides and is extendable over the open end.

5. The robot of claim 1 wherein the length of one of the ledges is longer than the length of the other ledge.

6. The robot of claim 1 including rotatable arm means on each of the third and fourth sides having vacuum means for handling slip sheets.

7. The robot of claim 1 including a box stripper for receiving a box from the robot and separating the product from the box comprising, a support for receiving an inverted box containing product, said support having first and second ends, vertical stop means at the first end and at the second end for positioning the box on the support, suction means at each of the first and second ends of the support for engaging and pulling opposite ends of the box away from the product in the box, movable clamping fingers adjacent each end of the support for moving the fingers into the box between the product and each end of the box, and means for moving the clamping fingers toward and away from each other for clamping the product therebetween.

8. The box stripper of claim 7 wherein the vertical stop means each includes spaced first and second stops, and said suction means at the each of the first and second ends are movable into a position between the spaced stops at the respective ends.

9. The box stripper of claim 7 wherein the vertical stop means at the second end is rotatable into and out of position.

10. A box stripper for receiving an inverted open box containing product for assisting in the separation of the product from the box comprising, a support for receiving an inverted open top box containing product, said support having first and second ends, vertical stop means at the first end and at the second end for positioning the box on the support, suction means at each of the first and second ends of the support for engaging and pulling opposite ends of the box away from the product in the box, movable clamping fingers adjacent each end of the support for moving the fingers into the box between the product and each end of the box, and means for moving the clamping fingers toward and away from each other for clamping the product therebetween.

11. The box stripper of claim 10 wherein the vertical stop means each includes spaced first and second stops, and said suction means at the each of the first and second ends are movable into a position between the spaced stops at the respective ends.

12. The box stripper of claim 10 wherein the vertical stop means at the second end is rotatable into and out of position.

13. The box stripper of claim 10 wherein said suction means at each of the first and second ends are rotatably connected to the first and second ends of the support, respectively.

* * * * *